US006295703B1

(12) United States Patent
Adams et al.

(10) Patent No.: US 6,295,703 B1
(45) Date of Patent: Oct. 2, 2001

(54) DEVICE FOR ATTACHING OBJECTS TO FABRIC

(75) Inventors: Kathy S. Adams, Ralieigh; Michael J. Knowles, Fayetteville, both of NC (US); Mark L. Kornhauser, Solon, OH (US); Jack Gee, II, Huntsville, AL (US)

(73) Assignee: Clip It 2, Inc., Raleigh, NC (US)

( * ) Notice: Subject to any disclaimer, the term of this patent is extended or adjusted under 35 U.S.C. 154(b) by 0 days.

(21) Appl. No.: 09/390,905

(22) Filed: Sep. 7, 1999

(51) Int. Cl.[7] ..... A44B 1/04

(52) U.S. Cl. ..... 24/459; 24/114.12; 24/114.9; 224/194

(58) Field of Search ..... 224/194, 271, 224/272; 24/459, 114.4, 114.05, 114.9, 114.12, 3.1, 462; 40/1.5

(56) References Cited

U.S. PATENT DOCUMENTS

| | | | |
|---|---|---|---|
| D. 270,244 | | 8/1983 | McCormick . |
| D. 292,677 | | 11/1987 | Jordi . |
| D. 313,758 | | 1/1991 | Klose . |
| D. 313,759 | | 1/1991 | Nomizu . |
| D. 322,762 | | 12/1991 | Miller . |
| 571,425 | | 11/1896 | Wood . |
| 1,113,211 | | 10/1914 | Greenebaum . |
| 1,559,210 | | 10/1925 | Wetherell . |
| 1,589,158 | * | 6/1926 | Hedison . |
| 2,333,428 | | 11/1943 | Kinsey . |
| 2,472,235 | * | 6/1949 | Sullivan . |
| 3,492,809 | | 2/1970 | Gisiger-Lusa . |
| 4,705,408 | | 11/1987 | Jordi . |
| 4,793,155 | | 12/1988 | Law . |
| 5,033,170 | * | 7/1991 | Ewert . |
| 5,035,000 | | 7/1991 | Matthias . |
| 5,046,222 | * | 9/1991 | Byers et al. . |
| 5,156,023 | | 10/1992 | Bevolo . |
| 5,511,289 | * | 4/1996 | Melia . |
| 5,610,877 | | 3/1997 | Adams et al. . |
| 5,655,271 | | 8/1997 | Maxwell-Trumble et al. . |

FOREIGN PATENT DOCUMENTS

| | | |
|---|---|---|
| 60883 | of 1912 | (CH) . |
| 680327-A | 8/1992 | (CH) . |
| 3143-546-A1 | 6/1983 | (DE) . |
| 507295 | 6/1939 | (GB) . |

* cited by examiner

*Primary Examiner*—James R. Brittain
(74) *Attorney, Agent, or Firm*—A. Jose Cortina; Kilpatrick Stockton LLP

(57) ABSTRACT

The present invention provides an apparatus which facilitates attachment of objects to fabrics of various thicknesses while minimizing damage to the underlying fabric. A device is provided which includes a backing member formed from a flexible, resilient material which is shaped to surround and engage a majority of the periphery of an object to be attached to fabric. The backing member has an inner peripheral wall and an outer peripheral wall opposite the inner peripheral wall. At least one continuous discontinuity passes through both the inner and the outer peripheral walls allowing the backing member to expand in order to receive objects of various size. Another aspect of the present invention provides a tensioning device which serves to bias the backing member into contact with the fabric and the object.

10 Claims, 3 Drawing Sheets

DEVICE FOR ATTACHING OBJECTS TO FABRIC

FIELD OF THE INVENTION

The invention relates generally to devices used to attach objects to fabric. More particularly, the invention relates to a device which can be used to attach objects to fabrics of various thicknesses without damaging the fabric.

BACKGROUND OF THE INVENTION

It is often desirable to attach various accessories and devices to clothing. For example, it is desirable to attach accessories such as jewelry to clothing for the purpose of displaying the accessory. It is also often desirable to attach a device to clothing for a special purpose. For example, individuals in the medical profession (such as dentists, hygienists, doctors, and nurses) and other professions using protective clothing (for example, fire and rescue personnel) commonly use gloves or long-sleeved exterior clothing which would obscure a watch worn on the person's wrist. It is therefore sometimes desirable to attach a watch to the exterior of a person's clothing to give the person ready access to the watch without having to remove gloves or pull back a covering sleeve of a garment. Different types of attaching means have been invented for this purpose. An example of such an attaching means is disclosed in U.S. Pat. No. 5,610,877 .

The attaching devices known in the art, however, suffer from several deficiencies. First, many of the attaching devices harm the fabric they are attach to by puncturing the fabric or permanently altering the fabric. Neither of these results is desirable because it is expected that a person may desire to attach a device to fabric on certain occasions and not on other occasions. It is undesirable to have the fabric damaged so that the fabric could not be worn without a device attached to cover up any permanent mark made by the attaching device.

Yet another deficiency of the known devices is that they are unable to adapt to fabric of various thicknesses. For example, many of the known devices rely on wedging fabric between the object to be attached to the fabric and some structure located behind the fabric. Typically, the gap between the object and the structure located behind the fabric will only accommodate a small range of fabric thicknesses. If the gap is made relatively large to accommodate thick fabrics, it will not hold an object on thinner fabrics. Likewise, a gap which accommodates a thin fabric will not be able to accept a thicker fabric. It is therefore desirable to have a device for attaching objects to fabrics of a greater range of thicknesses.

SUMMARY OF THE INVENTION

The present invention provides an apparatus well-suited for attaching objects while minimizing any damage to the underlying fabric. The present invention also facilitates attachment of objects to fabrics of various thicknesses.

According to one aspect of the present invention, a device is provided which enables attaching an object to fabric. The device includes a backing member formed from a flexible, resilient material which is shaped to surround and engage a majority of the periphery of an object to be attached to fabric. At least a portion of fabric is interposed between the backing member and the object. The backing member has an inner peripheral wall which contacts at least a portion of the fabric when the object is pressed into said backing member.

The backing member also has an outer peripheral wall opposite the inner peripheral wall. The backing member also has at least one continuous discontinuity through the inner and the outer peripheral walls which allows the backing member to expand in order to receive objects of various size. The backing member has a peripheral dimension such that when the object and the backing member are aligned on opposite sides of a fabric and pressed together, the fabric is held in place by compression between the backing member and the object.

According to a second aspect of the present invention, a device is provided which also includes a tensioning device which serves to bias the backing member into contact with the fabric and the object.

According to a third aspect of the present invention, the tensioning device is disposed in a partial indentation on the outer peripheral wall of the backing member.

According to a fourth aspect of the present invention, the device includes retaining members which are substantially "L" shaped and which extend from the outer peripheral wall to form a trough which retains a tensioning device in cooperation with the outer peripheral wall of the backing member.

According to a fifth aspect of the present invention, the "L" shaped retaining members may extend from the outer wall in a manner such that the troughs alternate between a position in which the opening of said trough faces toward the direction of insertion of the object and opposite the direction of insertion of the object.

In a sixth aspect of the present invention, a device for attaching an object to fabric is provided which includes a backing member formed from a flexible, resilient material and shaped to surround a majority of the periphery of an object to be attached to fabric with at least a portion of fabric interposed between the backing member and the object. The backing member has a generally annular shape, defined by an inner wall, an outer wall, and a height. The height is of sufficient measurement to receive and hold the object. The backing member has at least one discontinuity coextensive through its inner wall and outer wall, or annular shape, allowing the backing member to expand in order to receive objects of various size when the object and the backing member are aligned on opposite sides of a fabric and pressed together such that at least a portion of the fabric is held in place between the backing member and the object.

According to a seventh aspect of the present invention a device is provided wherein the annular shape of the backing member has a partial indentation on said inner wall for engaging the object.

Additional objects and advantages of the invention will become apparent to those skilled in the art upon reference to the detailed description and the included drawings.

PREFERRED EMBODIMENTS OF THE INVENTION

In general, a device according to the present invention is used to attach an object to the fabric by placing the backing member of the device on one side of a piece of fabric and aligning the object to be attached on the opposite side of the fabric from the backing member. The object to be attached to the fabric is then pressed into the fabric and the receiving backing member. The compressive force exerted by the backing member holds the object on the fabric. Unlike other devices which may hold objects in place on fabric, the present invention has the ability to expand and adapt to a greater range of fabric widths. In addition, by varying the compressive force exerted by the backing member, damage to fabric may be avoided. Specific embodiments of the present invention are discussed below with reference to the drawings.

According to an embodiment of the present invention shown in FIGS. 1–4, a device for attaching an object to fabric is provided which includes a backing member (11). The backing member is formed from a flexible, resilient material. A wide variety of materials are acceptable, such as plastics, rubber, or even resilient flexible metals. The material forming the backing member (11) should be sufficiently flexible to allow the backing member (11) to stretch to receive an object and the fabric accompanying the object. The material selected should be sufficiently resilient that is attempts to return to its original shape and exerts some degree of force against an object preventing the backing member (11) from returning to its original shape. This resiliency allows the backing member (11) to contact the fabric and hold both the object and the fabric by means of the compressive force exerted by the resiliency of the backing member (11). Nylon is a material that has been found to exhibit the necessary flexibility and resiliency to practice this embodiment of the present invention, and is the preferred material for making the invention. It is expected, however, that one of ordinary skill in the art would know how to select materials with the necessary resiliency for a particular use of the present invention.

Figure 6:
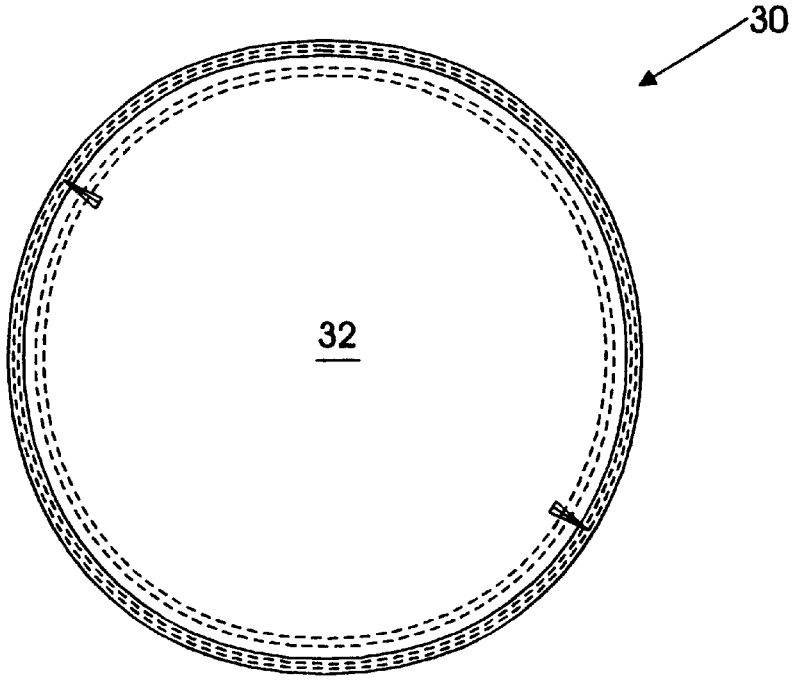
FIG. 6 is an elevational view of an object of an embodiment of the present invention.
Figure 7:
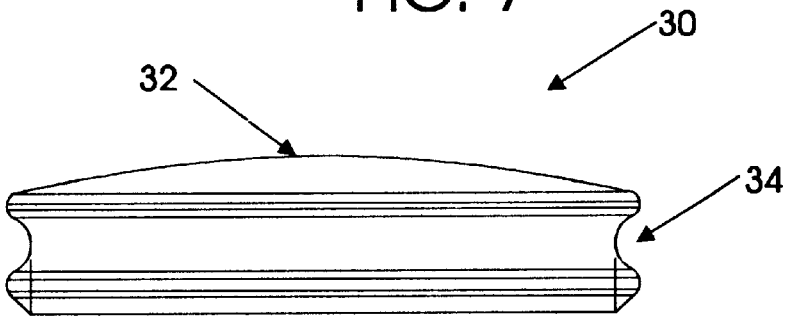
FIG. 7 is a top plan view of an object of an embodiment of the present invention.

The backing member (11) should be formed in a shape which will surround and engage a majority of the periphery of an object to be attached to fabric. In the preferred embodiment shown in FIGS. 1–4, the backing member is formed in a generally circinate to surround an object which is also generally circinate. An example of such an object (30) is shown in FIGS. 6 and 7. Although the preferred embodiment shown illustrates a circinate form, it is expected that there are objects of many geometrical shapes which a backing member may be formed to receive.

As noted above, it is not necessary for the backing member to surround all of the object to be received, it is only necessary that it receive a sufficient amount of the circumference of the object to enable the backing member (11) to hold the object in place. The amount of the object that must be surrounded in order to hold it in place will, of course, depend on the shape of the object and the flexibility and resiliency of the backing member (11).

Fabric is disposed between the object to be held in place and the backing member so that the object is held in place on the fabric. Often, the fabric will surround both the inner perimeter of the backing member and the outer perimeter of the object to be held. However, this is not necessary for practice of the present invention. It is possible to hold an object in place when only a portion of the supporting fabric is disposed between the object and the backing member. It is thus possible for the present invention to hold an object, for example, at the end of a piece of clothing such as the end of a sleeve of a shirt, where only a portion of the clothing fabric is placed between the backing member and the object to be attached.

Figure 1:
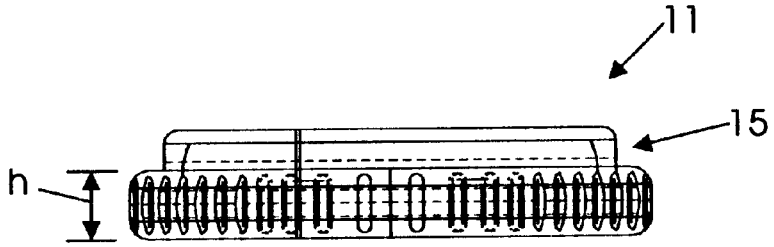
FIG. 1 is an elevational view of a backing member of an embodiment of the present invention.
Figure 2:
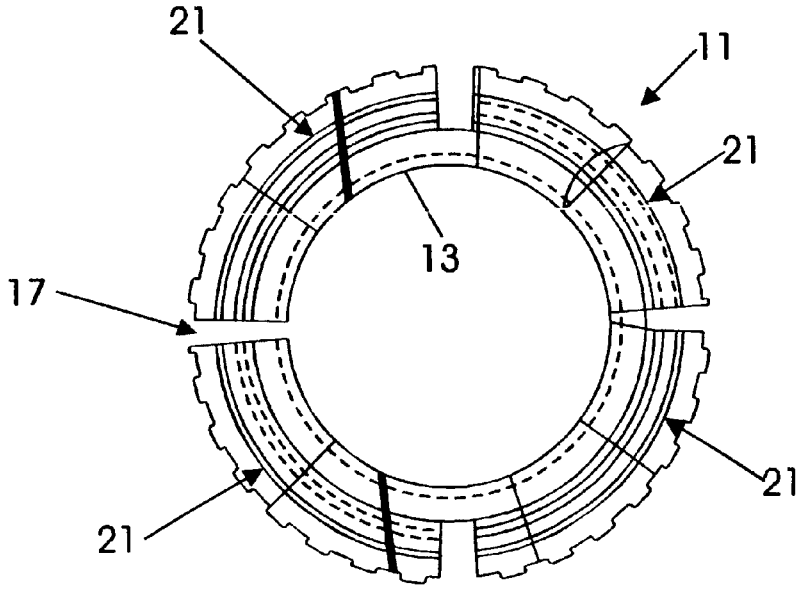
FIG. 2 is a top plan view of a backing member of an embodiment of the present invention.
Figure 3:
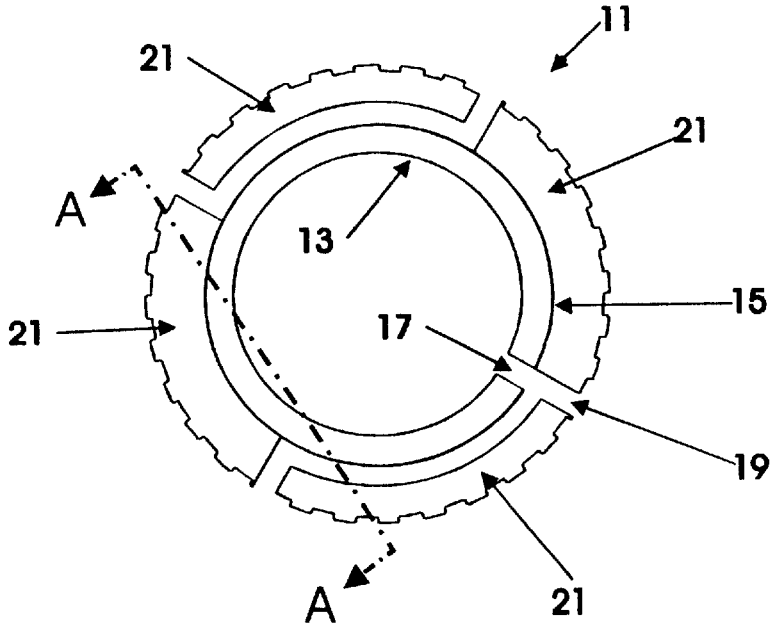
FIG. 3 is a top plan view of a backing member of an embodiment of the present invention.
Figure 4:
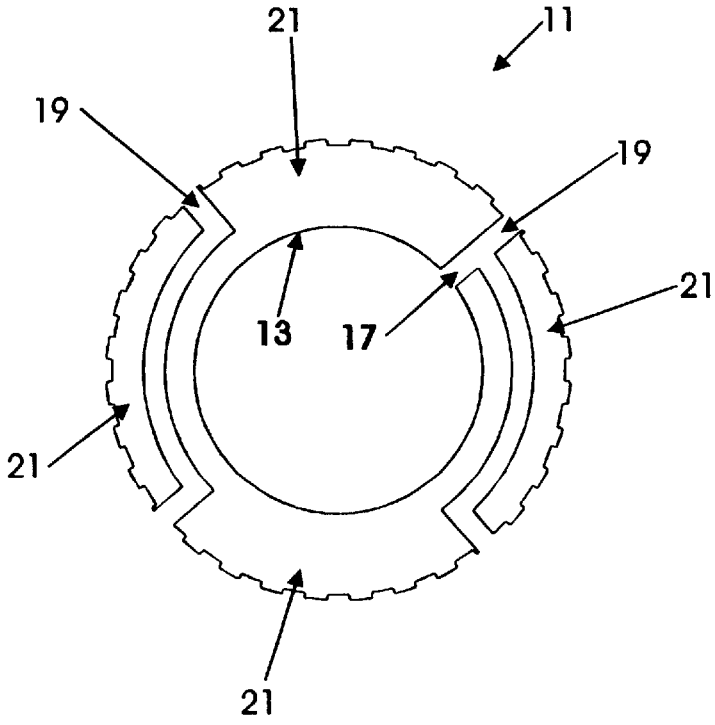
FIG. 4 is a bottom plan of a backing member of the embodiment of the present invention.
Figure 5:
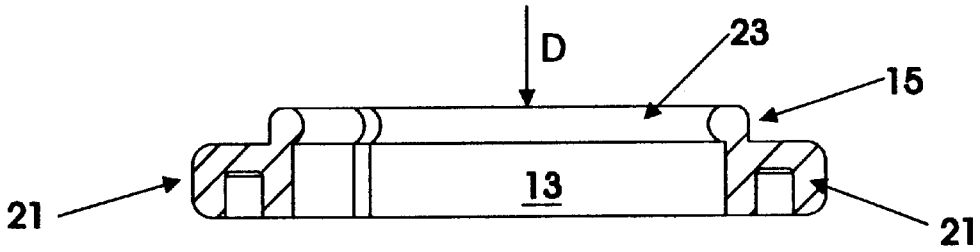
FIG. 5 is a cross section taken along line A—A in FIG. 3.

As seen in FIGS. 1 through 4, the backing member (11) has an inner peripheral wall (13) which contacts at least a portion of the fabric to which the object is to be attached when the object is pressed into said backing member. The inner peripheral wall (13) is of a sufficient height (h) that is will be able to surround a sufficient portion of the object to hold the object in position on the fabric. The backing member (11) also has an outer peripheral wall (15) opposite the inner peripheral wall (13). As shown in FIG. 5, the inner peripheral wall (13) has the same height as the outer peripheral wall (15).

The backing member (11) of the present invention also includes at least one continuous discontinuity (17) through both the inner and outer peripheral walls of the backing member. This discontinuity (17) increases the flexibility of the backing member and allows it to accept a greater range of fabric thicknesses because a backing material made of a given material will generally be able to expand to a greater degree than would be possible if the discontinuity (17) were not present. A backing member (11) with a discontinuity (17) is also generally able to conform to different shapes than one without a discontinuity. Additionally, by varying the resiliency of the backing member (11), the backing member (11) may be made such that it will not damage materials which are placed between the backing member (11) and the object to be attached. Selection of different construction materials and shapes for the backing member would make alteration of the backing member resiliency possible. As noted above, the backing member (11) should be made of such peripheral dimension that when an object and the backing member are aligned on opposite sides of a piece of fabric and pressed together, the fabric is held in place by compression between the backing member and the object.

The backing member (11) of the present invention may also be described as having a generally annular shape, defined by an inner wall (13), an outer wall (15), and a height (h). The height (h) is of sufficient measurement to receive and hold the object. The backing member (11) has at least one discontinuity (17) coextensive through its inner wall (13) and outer wall (15), or annular shape. The discontinuity (17) allows the backing member (11) to expand in order to receive objects of various size. To attach an object to a piece of fabric, the object and the backing member (11) are aligned on opposite sides of a fabric and pressed together such that at least a portion of the fabric is held in place between the backing member and the object.

In a preferred embodiment of the instant invention, a tensioning device (19) is employed in conjunction with the backing member to more securely hold the object to the fabric. Types of tensioning devices (19) include bands made of rubber or similarly resilient material, metal rings having a closing spring force, and connectors made of rubber which connect the parts of the backing member across the discontinuities in the backing member.

The tensioning device (19) may be attached to the backing member in many different ways. For example, a partial indentation could be formed on the outer peripheral wall of the backing member which would then receive and hold the tensioning device in place using the force of the tensioning device itself. Alternatively, in a preferred embodiment which is illustrated in FIGS. 1 through 5, the backing member could be formed such that a series of "L" shaped troughs (21) extend from the outer peripheral wall thus forming a trough to receive the tensioning device. In the preferred embodiment illustrated in FIGS. 1–5, the "L" shaped members alternate between having an opening which faces in the direction of insertion of the object (D) and facing in the opposite direction. A section illustrating the trough which faces away from the direction of insertion of the device to be held (D) is shown in FIG. 5.

FIGS. 6 and 7 show an object (30) which may be held in place by the backing member of the present invention shown in FIGS. 1–5. Many types of designs may be imprinted onto the face (32) of the object (30). Alternatively, pictures and similar types of items may be applied to the face (32) of the object. In a preferred embodiment of the invention, items such as clocks and medallions may be shaped in the form of the object (30) itself and be held in place by the backing member (11).

FIGS. 5 and 7 also show that a preferred embodiment of the present invention incorporates a backing member (11) which has a protrusion (23) at some point on the inner surface (13) of the backing member (11). This protrusion (23) cooperates with the indentation (34) of the object to be held in place on the fabric by the backing member (11). Although it is preferred to incorporate the illustrated protrusion (23) and indentation (34) into the present invention, it is not necessary in order to practice the invention.

Numerous modifications and variations of the present invention are possible in light of the above teachings. It should therefore be understood that within the scope of the invention as defined by the claims below, the invention may be practiced other than in the specific manner and embodiments described above.

What is claimed is:

1. A device for attaching an object to fabric, comprising:

a backing member formed from flexible, resilient material, and shaped to surround and engage a majority of the periphery of an object to be attached to fabric with at least a portion of fabric interposed between the backing member and an object to be received therein;

an inner peripheral wall on said backing member for contacting at least a portion of fabric when said object is pressed into said backing member, and an outer peripheral wall on said backing member opposite said inner peripheral wall, and having a partial indentation for receiving a tensioning device therein;

at least one continuous discontinuity through said inner and said outer peripheral walls for allowing said backing member to expand for receiving objects of various sizes;

a tensioning device receivable in said partial indentation for biasing said backing member into contact with fabric and an object when fabric and object are received by said backing member; and said backing member having a peripheral dimension such that when an object and said backing member are aligned on opposite sides of fabric and pressed together, the fabric is held in place by compression between said backing member and an object and fabric when received therein.

2. A device according to claim 1, further comprising retaining members which are substantially "L" shaped extending from said outer wall to form a trough for retaining said tensioning device in cooperation with said outer wall of said backing member.

3. A device according to claim, wherein said "L" shaped retaining members extend from said outer wall in a manner such that said troughs alternate between a position in which the opening of said trough faces toward the direction of insertion of said object and the direction opposite the direction of insertion of said object.

4. A device according to claim 1 wherein said tensioning device is a flexible "O" ring.

5. A device for attaching an object to fabric according to claim 1, further comprising an object shaped for being retained in contact with said backing member as a result of compression between said backing member and said object.

6. A device for attaching an object to fabric, comprising:

a backing member formed from flexible, resilient material, and shaped to surround a majority of the periphery of an object to be attached to fabric with at least a portion of fabric interposed between the backing member and an object to be received therein;

said backing member having a generally an annular shape, defined by an inner wall, and an outer peripheral wall, the backing member having a height sufficient for receiving and holding an object therein, the inner wall having a convex partial indentation for engaging an object to be received therein, and the outer peripheral wall further comprising a partial indentation for receiving a tensioning device;

a tensioning device receivable in said partial indentation for biasing said backing member into contact with fabric and an object when received therein; and at least one continuous discontinuity coextensive through said inner wall and said outer peripheral wall which define said annual shape, for allowing said backing member to expand for receiving objects of various sizes in said backing member when an object and said backing member are aligned on opposite sides of fabric and pressed together for holding at least a portion of fabric in place between said backing member and an object, when fabric and an object are received in said backing member.

7. A device according to claim 6 further comprising retaining members for holding said tensioning device, which extend from said outer wall of said backing member, and said retaining members being generally "L" shaped and forming a trough for retaining said tensioning device in cooperation with said outer wall of said backing member.

8. A device according to claim wherein said "L" shaped retaining members extend from said outer wall in a manner such that said trough alternates between a position in which the opening of said trough faces toward the direction of insertion of said object and the direction opposite the direction of insertion of said object.

9. A device for attaching an object to fabric according to claim 6, further comprising an object shaped for being retained in contact with said backing member as a result of compression between said backing member and said object.

10. A device according to claim 6 wherein said tensioning device is a flexible "O" ring.

* * * * *

UNITED STATES PATENT AND TRADEMARK OFFICE

CERTIFICATE OF CORRECTION

PATENT NO. : 6,295,703 B1 
DATED : October 2, 2001
INVENTOR(S) : Kathy S. Adams, Michael J. Knowles, Mark L. Kornhauser and Jack Gee, II It is certified that error appears in the above-identified patent and that said Letters Patent is hereby corrected as shown below:

Column 5,
Line 6, after "A device according to claim" add -- 2 --

Column 5,
Line 53, after "A device according to claim" add -- 7 --

Signed and Sealed this

Fourteenth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,295,703 B1 
DATED : October 2, 2001
INVENTOR(S) : Kathy S. Adams, Michael J. Knowles, Mark L. Kornhauser and Jack Gee, II It is certified that error appears in the above-identified patent and that said Letters Patent is hereby corrected as shown below:

Column 6,
Line 6, after "A device according to claim" add -- 2 --
Line 51, after "A device according to claim" add -- 7 --

This certificate supersedes Certificate of Correction issued May 14, 2002.

Signed and Sealed this

Twentieth Day of May, 2002

*Attest:*

*Attesting Officer*

JAMES E. ROGAN
*Director of the United States Patent and Trademark Office*